United States Patent [19]

Koehler

[11] Patent Number: 4,837,668

[45] Date of Patent: Jun. 6, 1989

[54] REFLECTOR FOR DENTAL OR MEDICAL LIGHT

[76] Inventor: Joseph P. Koehler, 10523 Chillicothe, Kirtland, Ohio 44094

[21] Appl. No.: 149,410

[22] Filed: Jan. 28, 1988

[51] Int. Cl.[4] ..... F21Y 7/22

[52] U.S. Cl. ..... 362/297; 362/344; 362/804

[58] Field of Search ..... 362/347, 341, 804, 307, 362/296, 297, 344

[56] References Cited

U.S. PATENT DOCUMENTS

| | | | |
|---|---|---|---|
| D. 201,038 | 5/1965 | Sullivan et al. . | |
| D. 217,497 | 5/1970 | Valeska et al. . | |
| D. 264,508 | 5/1982 | Williams et al. . | |
| 2,069,950 | 2/1937 | Greppin . | |
| 2,093,457 | 9/1937 | Kuklin | 362/804 X |
| 2,179,491 | 11/1939 | Cain | 362/341 X |
| 2,280,402 | 4/1942 | Greppin . | |
| 2,287,191 | 6/1942 | Morehead | 362/341 X |
| 2,437,516 | 3/1948 | Greppin . | |
| 2,483,699 | 10/1949 | Greppin . | |
| 3,165,265 | 1/1965 | Clause | 362/344 |
| 3,191,023 | 6/1965 | Sullivan et al. . | |
| 3,644,730 | 2/1972 | Ogle et al. . | |
| 3,711,700 | 1/1973 | Westlund et al. . | |
| 3,832,539 | 8/1974 | Oram | 362/804 X |
| 4,254,454 | 3/1981 | Hardin . | |
| 4,254,455 | 3/1981 | Neal . | |
| 4,380,794 | 4/1983 | Lawson . | |
| 4,434,455 | 2/1984 | Merritt . | |
| 4,459,647 | 7/1984 | Yamauchi et al. | 362/804 X |
| 4,463,410 | 7/1984 | Mori . | |
| 4,516,195 | 5/1985 | Gonser . | |

FOREIGN PATENT DOCUMENTS

| | | | |
|---|---|---|---|
| 122643 | 9/1948 | Sweden | 362/804 |
| 724874 | 2/1955 | United Kingdom | 362/804 |
| 735732 | 8/1955 | United Kingdom | 362/804 |

*Primary Examiner*—Ira S. Lazarus
*Assistant Examiner*—Richard R. Cole
*Attorney, Agent, or Firm*—Fay, Sharpe, Beall, Fagan, Minnich & McKee

[57] ABSTRACT

A reflector for use in dental or medical lighting devices includes a glass substrate of predetermined shape for reflecting light in a predetermined pattern. The reflector has a front surface and a rear surface. A cover plate is utilized for covering the rear surface of the glass substrate. A securing device is provided for fastening the cover plate to the glass substrate in a selectively removable manner.

21 Claims, 2 Drawing Sheets

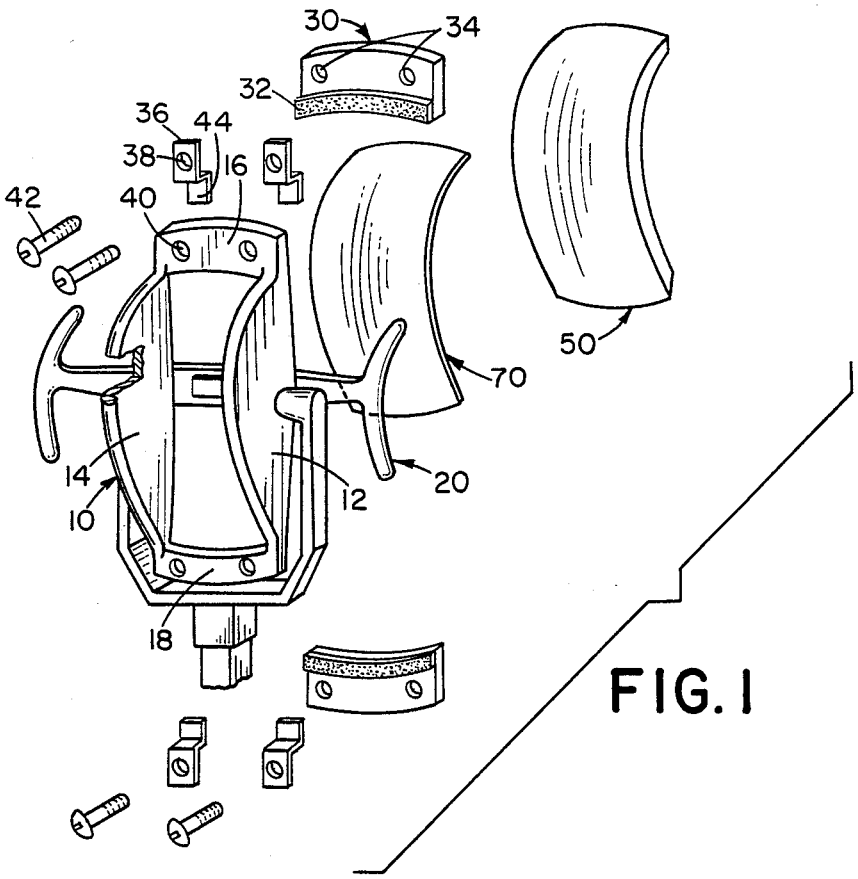
FIG. 1
FIG. 2
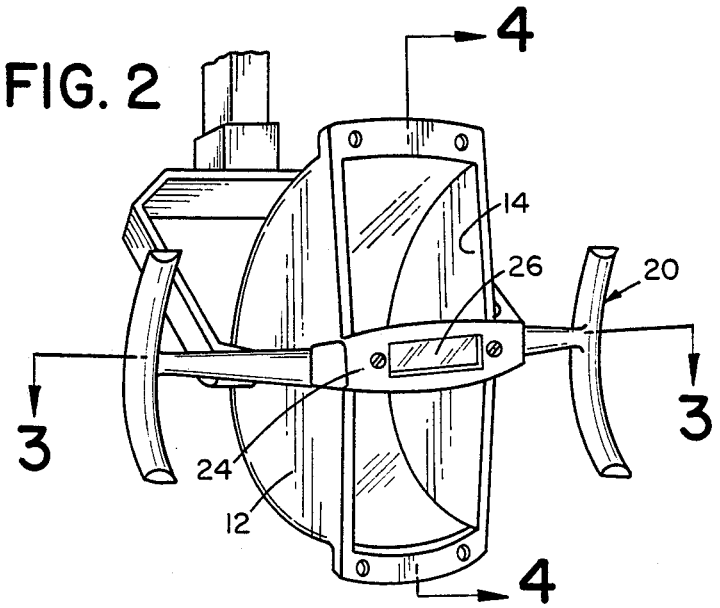

FIG. 3
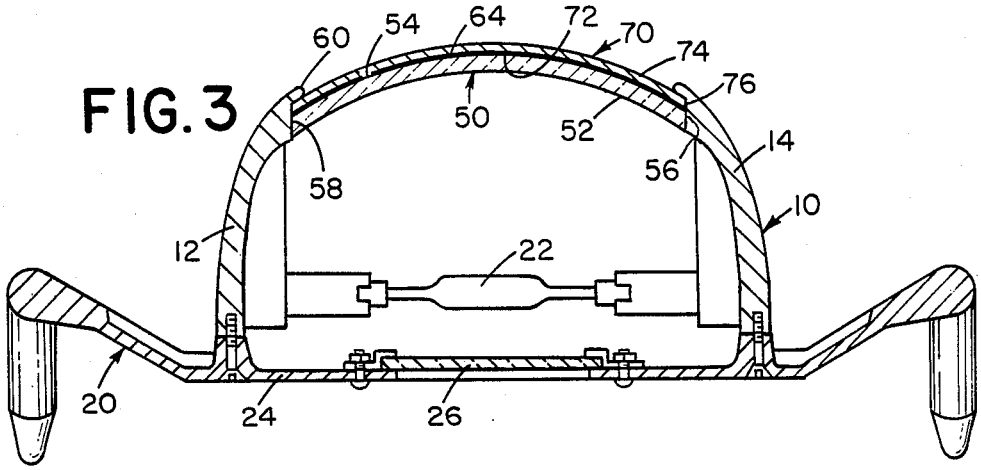
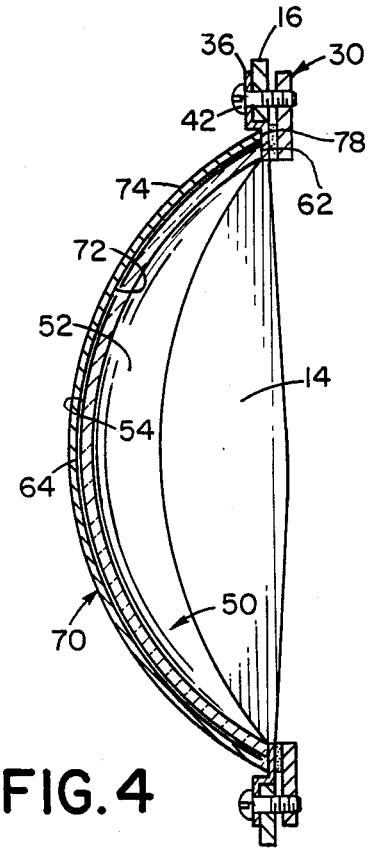
FIG. 4
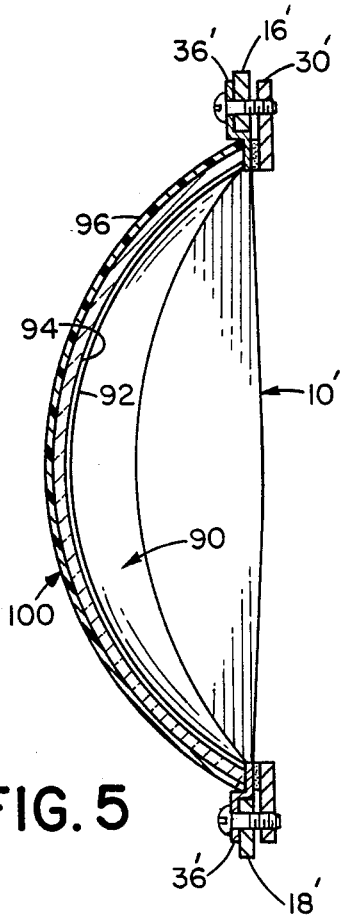
FIG. 5

REFLECTOR FOR DENTAL OR MEDICAL LIGHT

BACKGROUND OF THE INVENTION

This invention generally pertains to light reflectors. More specifically, the present invention relates to a light reflector assembly for use in dental or medical lighting devices in which a selectively detachable cover plate overlies a rear surface of a glass substrate.

The invention is particularly applicable to a dental light reflector in which a coating on a rear surface of a glass substrate has flaked off or peeled off. In accordance with the invention, a separate cover plate can then be secured over the substrate to put the light quickly and inexpensively back into operation. However, it will be appreciated by those skilled in the art that the invention has broader applications and may also be adapted for use in many other environments where the reflection of light is important.

Glass reflectors have been adopted in the dental and medical fields in order to reflect visible light in a predetermined pattern which avoids shining light into the eyes of a patient and concentrates the light in the area of the body to be operated on. It has been thought desirable that ultraviolet and infrared light not be reflected back at the patient thereby providing a "cool" light. When a glass substrate of the reflector is coated with a dichroic coating, it will satisfactorily reflect a substantial portion of visible light while allowing infrared and other undesirable light to pass therethrough. The dichroic coating is generally provided on the rear surface of the glass substrate. However, such a coating on the rear surface of the substrate can be easily damaged by the cleaning or handling of the reflector.

Accordingly, the conventional design provides a protective layer of a PTFE (Teflon) paint over the dichroic coating on the rear surface of the glass substrate to aid in preventing damage to the coating. The paint coating layer is also utilized to diffuse light passing through the reflector thereby reducing undesirable glare from the rear of the reflector. Such a conventional reflector, however, provides a problem in that the protective diffuser paint coating on the rear surface of the glass substrate peels off after a period of use. This peeling also damages or destroys the dichroic coating on the rear surface of the substrate. Although it is not known for certain what causes such peeling, it is believed that one factor may be the tremendous temperature swings (e.g. from 25° C. when the lamp is off to above approximately 150° C. when the lamp is on) that the substrate and two coating layers are exposed to in combination with the differential thermal expansion rates of the several materials. Another factor would likely be any wiping contact with the coating during cleaning.

In addition to being unsightly, the flaking of the coating allows light to pass through the glass substrate producing a glaring out the back side of the reflector. The resulting loss of light is disadvantageous because onlookers from the rear side of the lamp are met with an intense glare and useful light intensity is diminished in the forward direction. This problem is presently dealt with by recoating the back surface of the glass substrate with another dichroic coating layer and a protective paint coating thereon. This, however, is done at considerable expense and works only until such time as the new coating begins to flake off.

One advance over the known paint coating on the rear surface of the glass substrate has been the use of a reflector in which the dichroic coating is applied on the front surface of the glass substrate and the rear surface thereof is covered with a ceramic frit material. However, the ceramic frit coating also appears to be prone to chipping, peeling, or flaking after some period of reflector use.

An additional problem with the PTFE paint coating on the glass substrate rear surface is that whereas the rest of the dental operatory facility can be sterilized with a conventional sterilant wipe liquid, the substrate rear surface, which usually is also the back surface of the reflector, is not so sterilized. In this regard, the instructions for use of the conventional reflector state that the back surface of the glass substrate should not be cleaned with anything other than a dry cloth so that the coating on the substrate rear surface is not damaged, abraded away or washed away by the sterilization.

Accordingly, it has been considered desirable to develop a new and improved reflector which would overcome the foregoing difficulties and others and meet the above-stated needs while providing better and more advantageous overall results.

BRIEF SUMMARY OF THE INVENTION

In accordance with the present invention, a new and improved reflector is provided for use in a dental or medical lighting device.

More particularly in accordance with the invention, the reflector comprises a glass substrate having a predetermined shape for reflecting light in a predetermined pattern and having a front surface and a rear surface. A cover plate is provided for covering the rear surface of the glass substrate. A securing means is provided for fastening the cover plate to the glass substrate in a selectively removable manner.

In accordance with another aspect of the invention, the reflector further comprises a dichroic coating means provided on one of the front and rear surfaces of the glass substrate for reflecting a substantial portion of visible light.

According to still another aspect of the invention, the reflector further comprises a diffuser means for diffusing light passing through the glass substrate, as desired.

According to yet another aspect of the invention, the cover plate includes a translucent material which comprises said diffuser means. Preferably, the translucent material comprises a plastic material which can withstand temperatures up to approximately 170° Centigrade without deteriorating.

According to yet another aspect of the invention, the cover plate comprises a metallic material. Preferably, the cover plate has a front surface located adjacent the glass substrate rear surface and a back surface, and wherein the cover plate front surface is polished in order to reflect more light back through the glass substrate.

One advantage of the present invention is the provision of a new and improved reflector for dental or medical lighting devices.

Another advantage of the invention is the provision of a reflector which can be sterilized along with the rest of the dental or medical operatory theater.

Still another advantage of the present invention is the provision of an inexpensive reflector cover plate which can be readily retrofitted on reflector glass substrates which have suffered peeling problems either of the conventional PTFE paint coating thereon or of the conventional ceramic frit coating thereon.

Yet another advantage of the present invention is the provision of a reflector cover plate which can be made from either plastic or metallic material and from either translucent or opaque material.

Yet still another advantage of the present invention is the provision of a reflector cover plate which can be selectively secured to or removed from a rear surface of a reflector glass substrate, as desired.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts preferred embodiments of which will be described in detail in this specification and illustrated in the accompanying drawings which form a part hereof and wherein:

FIG. 1 is an exploded perspective view of a lighting device for use in a dental or medical setting according to the present invention;

FIG. 2 is an assembled perspective view of the lighting device of FIG. 1;

FIG. 3 is cross-sectional view along line 3—3 of the lighting device of FIG. 2;

FIG. 4 is a cross-sectional view along line 4—4 of the lighting device of FIG. 2; and, FIG. 5 is a cross-sectional view of second preferred embodiment of a lighting device according to the present invention.

DETAILED DESCRIPTION OF THE PREFERRED EMBODIMENTS

Referring now to the drawings, wherein the showings are for purposes of illustrating preferred embodiments of the invention only and not for purposes of limiting same, FIG. 1 shows the subject new lighting device. While the lighting device is primarily designed for and will hereinafter be described in a dental or medical operating theater setting, it will be recognized that the overall inventive concept involved could also be adapted for use in other lighting environments as well.

With reference now to FIG. 1, the lighting device includes a frame 10 which comprises first and second side walls 12, 14 as well as top and bottom end walls 16, 18 which connect the side walls to each other. A handle 20 is provided on the frame and extends from each of the side walls as is illustrated better in FIG. 2. A light source 22 is provided in the frame behind a front portion 24 of the handle 20 as illustrated in FIG. 3 (the light source is not shown in FIGS. 1 and 2 so that the frame 10 can be more clearly illustrated). The handle front portion 24 can have a glass panel 26 located in an aperture in the front portion.

Also provided in conjunction with the frame is a pair of auxiliary frame members 30. Since the two members are identical, only the upper member will be discussed, it being appreciated that the lower member performs the same functions. The auxiliary frame member 30 includes a cushioning pad 32 positioned on an inside surface thereof as well as a pair of threaded apertures 34 which are spaced away from each other as well as from the cushioning pad. Also provided are a pair of bracket members 36. Each of the brackets includes a bracket aperture 38 which is aligned with a corresponding aperture 40 in the frame top wall 16 and the aperture 34 in the auxiliary frame member 30. These apertures are aligned so that a suitable fastener 42 can extend therethrough to secure these three elements selectively together. It should be noted that the brackets 36 each include a depending bracket leg 44.

A glass substrate 50 is selectively positionable in the frame 10 and can be secured therein through the use of the pair of auxiliary frame members 30 and the brackets 36. With reference now more specifically to FIG. 3, the glass substrate 50 has a front surface 52 and a rear surface 54. A pair of side edges 56 of the substrate are adapted to fit in corresponding slots 58 provided in the frame side walls 12, 14. Each slot 58 is defined in the respective frame side wall 12, 14 by an outwardly extending flange 60 which is adapted to prevent the glass substrate 50 from falling out of the frame 10 (i.e. moving upwardly in the frame as illustrated in FIG. 3).

Downward movement of the substrate 50 in the frame 10 as illustrated in FIG. 3 is prevented by the cooperation of the frame top and bottom walls 16, 18 with a respective one of the auxiliary frame members 30 and the brackets 36 as is more clearly illustrated in FIG. 4. Once the fastener 42 is inserted through the bracket aperture 38, through the frame aperture 40 and into the threaded aperture 34 of the auxiliary member, the three elements can be fastened together to hold a respective top and bottom edge 62 of the glass substrate in place in the frame 10.

Conventionally provided on the rear surface 54 of the glass substrate 50 is a suitable coating 64. Generally, this coating is a conventional dichroic coating for reflecting a substantial portion of visible light and for allowing infrared and other undesirable energy along with some unreflected visible light to pass through the glass substrate so that only so-called cool light is reflected. Atop the dichroic coating layer, there could also be positioned a paint layer. The latter is made of a suitable conventional PTFE (Teflon) paint which is layered atop the dichroic coating to aid in preventing damage thereto and to act as a diffusing medium for the light passing through the dichroic coating.

As mentioned previously, such coatings have a tendency to peel or flake away from the rear surface of the reflector 50 after some amount of use thereby leaving large open areas or gaps thereon. Light passes through such areas instead of being reflected thereby negating the function of the reflector.

Even in the newer types of dental or medical lighting devices which put the dichroic coating on the front surface of the glass substrate and just have a ceramic frit coating on the rear surface thereof, the ceramic frit coating has a tendency to flake or peel off the glass substrate of the reflector.

In order to speedily and inexpensively put such reflectors back into operation, a suitably sized cover plate 70 is provided according to the present invention. The cover plate 10 is meant to overlie the glass reflector 50. The plate can have a front surface 72 which lies adjacent to whatever coating layer may be provided on the rear surface of the glass substrate as well as a back surface 74 which will define the rear or accessible face of the reflector assembly for cleaning and sterilizing purposes. The plate 70 can also be provided with a pair of suitable side edges 76 so that it fits in the slots 58 provided in the frame. Suitable top and bottom edges 78 can be provided on the plate so that the plate can be secured in the frame by the auxiliary frame members 30 and brackets 36 in the same manner as the glass reflector 50. This construction of the cover plate 70 is evident from FIGS. 3 and 4.

In one embodiment, the plate can be made of a suitable opaque material which can be a metal such as aluminum or steel. It is recognized that this type of construction would not allow the so called "undesirable" light rays in the infrared and ultraviolet range to escape through the rear surface of the glass reflector. Such light rays would instead be reflected back through the substrate towards the operatory theater. It has been determined, however, that while such rays do increase the ambient temperature adjacent a patient by several degrees, such a temperature increase does not adversely affect either the patient or the physician or dentist operating on the patient.

More specifically, it has been determined that the reflection of these light rays by a metallic cover plate increases the temperature adjacent the mouth of a dental patient by approximately 10° F. After some experimentation, it has been determined that this temperature increase does not pose any hazard or any inconvenience to either the dentist or the patient. It is judged that the modest increase in temperature adjacent the dental operatory region is a price well worth paying for putting a previously disabled dental operating light back into operation through the simple expedient of adding a cover plate thereon. Such a retrofit is considerably less expensive than a recoating of the glass substrate rear surface. Also, while such a recoating would again peel in time and require yet another recoating, the plate according to the present invention is believed to relatively immune to damage from use.

The plate 70 has the additional benefit that it permits sterilization of the rear surface of the reflector assembly, which was not heretofore possible with the conventionally used glass reflectors, thereby insuring that the entire operating theater can be sterilized.

If desired, the plate front surface 72 can be polished to more efficiently reflect light back through the glass substrate 50.

The cover plate 70 can be selectively attached to and removed from the rear surface of the glass substrate. Removal of the cover plate may be advantageous for sterilization purposes, such as autoclaving. Also, if the rest of the reflector assembly is eventually discarded due, for example, to cracks in the glass substrate or wiring problems in the electrical circuit of the lamp, the cover plate can be removed and retrofitted on another reflector assembly.

With reference now to the second preferred embodiment of FIG. 5, the invention is there shown in a different reflector assembly. For ease of illustration and appreciation of this alternative, like components are identified by like numerals with a primed (') suffix and new components are identified by new numerals.

In this FIGURE, a frame 10' is similarly provided with a pair of auxiliary frame members 30' to hold a suitable glass reflector 90 in place therein by the cooperation of a plurality of brackets 36' with the auxiliary members and top and bottom walls 16', 18' of the frame 10'. In this embodiment, however, the glass reflector 90 which is of the same shape as the glass reflector 50 illustrated in FIGS. 3 and 4, has a coating 92 on the front wall 94 thereof instead of on the rear wall 96 thereof. The coating 92 can be a dichroic coating such as was described hereinabove in relation to the first preferred embodiment. Positioned adjacent the rear wall 96 of the glass reflector 90 is a suitable plate 100 which can have the same shape as the plate 70 of the first preferred embodiment. In this embodiment, however, the plate is constructed of a suitable translucent material such as a plastic material.

One such plastic material is a molded polyetherimide. A suitable polyetherimide resin is sold by the General Electric Company under the registered trademark ULTEM. This material can function continuously at temperatures up to 170° C. Furthermore, the material is stable to the extent that it is almost immune to ultraviolet light. It should be recognized, however, that several other conventional types of plastics can also be employed in this type of application. Such plastics can, for example, include polyphenylene sulfide and polysulfone.

The polyetherimide cover plate 100 is transparent to infrared radiation and would therefore allow such radiation through the plate instead of reflecting it back into the medical or dental operating theater. Therefore, since both the dichroic coating and the plate 100 would allow infrared radiation to pass therethrough, the temperature increase which was mentioned in connection with the first preferred embodiment would not exist.

It should be recognized that the plate 100 can also be used with the glass substrate discussed in the first preferred embodiment of FIGS. 1–4. Of course, in that environment the rear surface of the substrate may have to be recoated with a dichroic coating or the like if that coating has peeled off. No recoating with the PTFE paint would be required, however. Alternatively, a dichroic layer could be provided on the front surface of the plate.

As with the metallic plate disclosed in FIGS. 1–4, the plastic plate could be readily sterilized in order to allow the entire operatory theater to be in a sterile condition.

The invention has been described with reference to preferred embodiments. Obviously, alterations and modifications will occur to others upon a reading and understanding of this specification. It is intended to include all such modifications and alterations insofar as they come within the scope of the appended claims or the equivalents thereof.

What is claimed is:

1. A reflector for use in a dental or medical lighting device, comprising:

a glass substrate of a predetermined paraboloidal shape for reflecting light in a predetermined pattern and having a front surface and a rear surface, wherein one of said front and rear surfaces is a reflecting surface;

a paraboloidal cover plate for covering said rear surface of said glass substrate, wherein said cover plate also has a reflecting surface; and, a securing means for fastening said cover plate to said glass substrate in a selectively removable manner.

2. The reflector of claim 1 further comprising a dichroic coating means provided on one of said front and rear surfaces of said glass substrate for reflecting a substantial portion of visible light.

3. The reflector of claim 1 further comprising a diffuser means for diffusing light passing through said glass substrate.

4. The reflector of claim 3 wherein said cover plate includes a translucent material which comprises said diffuser means.

5. The reflector of claim 4 wherein said translucent material comprises a plastic material which can withstand temperatures up to approximately 170° C. without deteriorating.

6. The reflector of claim 1 wherein said cover plate comprises a metallic material.

7. The reflector of claim 6 wherein said cover plate has a front surface located adjacent said glass substrate, and a back surface and wherein said front surface is polished in order to more efficiently reflect light back through said glass substrate.

8. A reflector assembly for a dental or medical lighting device including a glass reflector having a coating on a rear surface thereof and a cover plate which can be secured on the reflector rear surface when the coating thereon has begun to peel off, the assembly comprising:

a glass substrate of a predetermined paraboloidal shape for reflecting light in a predetermined pattern and having a front surface and a rear surface wherein one of said front and rear surfaces is a reflecting surface;

a frame means for holding said glass substrate;

a cover plate having a front surface and a rear surface, said cover plate having a suitable predetermined paraboloidal shape so that said cover plate front surface can closely overlie said glass substrate rear surface and wherein said cover plate also has a reflecting surface; and, a securing means for fastening said cover plate to said glass substrate in a selectively removable manner.

9. The assembly of claim 8 further comprising a coating layer on said glass substrate rear surface.

10. The assembly of claim 9 wherein said coating layer comprises a dichroic coating means for reflecting a substantial portion of visible light and for allowing infrared and other undesirable energy along with any unreflected visible light to pass through said glass substrate so that cool light only is reflected.

11. The assembly of claim 9 wherein said coating layer comprises a diffuser coating means for diffusing light passing through said glass substrate to reduce undesirable glare from said rear surface of said glass substrate.

12. The assembly of claim 8 further comprising a means for allowing a rear face of the assembly to be sterilized.

13. The assembly of claim 8 wherein said cover plate comprises a metallic material.

14. The assembly of claim 8 wherein said cover plate comprises a plastic material.

15. A lighting device for use in a dental or medical setting comprising:

a glass substrate of a predetermined shape for reflecting light in a predetermined pattern and having a front surface and a rear surface;

a frame means for holding said glass substrate;

a light source carried by said frame means for providing light to said glass substrate when energized; and, a cover plate for covering said rear surface of said glass substrate, said cover plate having a reflective surface and also having a shape which can closely overlie said glass substrate, said cover plate being selectively secured in said frame means in overlying relation to said glass substrate rear surface.

16. The device of claim 15 further comprising a coating layer on said glass substrate rear surface.

17. The device of claim 15 wherein said cover plate comprises a translucent material.

18. The device of claim 15 wherein said cover plate comprises an opaque material.

19. The device of claim 15 wherein said cover plate allows a rear face of the device to be sterilized.

20. A method for refurbishing a dental or medical lighting device in which a coating on a rear surface of a glass substrate has begun to peel off, comprising:

providing a lighting device including a frame and a glass substrate;

determining that a coating on a rear surface of said glass substrate has begun to peel off;

providing a cover plate which has reflecting characteristics;

detaching said glass substrate from said frame;

positioning said cover plate on a rear surface of said glass substrate in an overlying relationship thereto; and, simultaneously securing said cover plate and said glass substrate to said frame.

21. The method of claim 20 further comprising the step of:

recoating a rear surface of said glass substrate with a coating layer prior to said step of positioning said cover plate.

* * * * *